US008695826B2

(12) United States Patent
Furey

(10) Patent No.: US 8,695,826 B2
(45) **Date of Patent: *Apr. 15, 2014**

(54) NESTABLE BEVERAGE CONTAINERS AND METHODS THEREOF

(71) Applicant: James Furey, Morganville, NJ (US)

(72) Inventor: James Furey, Morganville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/735,901

(22) Filed: Jan. 7, 2013

(65) Prior Publication Data

US 2013/0118943 A1 May 16, 2013

Related U.S. Application Data

(63) Continuation-in-part of application No. 12/840,176, filed on Jul. 20, 2010, now Pat. No. 8,348,051.

(51) Int. Cl.
*A47G 19/23* (2006.01)

(52) U.S. Cl.
USPC ..... 220/23.83; 206/503

(58) Field of Classification Search
USPC ..... 206/503, 508, 509, 515, 520; 220/23.83, 23.86, 574; 215/10
See application file for complete search history.

(56) References Cited

U.S. PATENT DOCUMENTS

| | | | | |
|---|---|---|---|---|
| 475,231 | A | 5/1892 | Anderson | |
| 769,615 | A | 9/1904 | Kosansvich | |
| 2,488,611 | A | 11/1949 | Stallings | |
| 3,067,896 | A | 12/1962 | Berg et al. | |
| 5,417,327 | A | 5/1995 | Saumure | |
| 5,695,052 | A * | 12/1997 | Damato | 206/217 |
| 7,992,714 | B1 * | 8/2011 | Devault et al. | 206/564 |
| 2009/0045157 | A1 | 2/2009 | Panchal et al. | |
| 2011/0226719 | A1 | 9/2011 | Park | |

FOREIGN PATENT DOCUMENTS

| | | | |
|---|---|---|---|
| FR | 2684072 | A1 | 5/1993 |
| JP | 10-167276 | A | 6/1998 |

OTHER PUBLICATIONS

Form PCT/ISA/220, "Notification of Transmittal of the International Search Report and the Written Opinion of the International Searching Authority", Mailed Feb. 29, 2012 for PCT/US11/40951, 2 pgs.
Form PCT/ISA/210, "International Search Report", Mailed Feb. 29, 2012 for PCT/US11/40951,3 pgs.
Form PCT/ISA/237, "Written Opinion of the International Searching Authority", Mailed Feb. 29, 2012 for PCT/US11/40951, 4 pgs.

* cited by examiner

*Primary Examiner* — Jeffrey Allen
(74) *Attorney, Agent, or Firm* — Jon Fallon, Esq.

(57) ABSTRACT

Embodiments of the present invention generally relate to nested beverage containers and methods thereof. More specifically, embodiments of the present invention relate to improved beverage containers having interlocking features with adjacent containers, allowing for ease of transportation and lower cost of packaging. In one embodiment, a nestable beverage container comprises a top portion comprising an opening into a voluminous body, a sealing means, and a connection means positioned beneath the sealing means, a bottom portion comprising a receiving means shaped to conform to the connection means of an adjacently nested container, and the voluminous body being defined by the top portion, the bottom portion and a side wall, wherein the opening into the voluminous body is the only means for accessing contents of the nestable beverage container.

10 Claims, 9 Drawing Sheets

NESTABLE BEVERAGE CONTAINERS AND METHODS THEREOF

CROSS-REFERENCE TO RELATED APPLICATIONS

This application is a continuation-in-part of U.S. patent application Ser. No. 12/840,176, filed Jul. 20, 2010, and titled "Nested Beverage Containers and Methods Thereof," the disclosure of which is incorporated herein by reference in its entirety.

BACKGROUND OF THE INVENTION

1. Field of the Invention

Embodiments of the present invention generally relate to nested beverage containers and methods thereof. More specifically, embodiments of the present invention relate to improved beverage containers having interlocking features with adjacent containers, allowing for ease of transportation and significantly lower cost of packaging.

2. Description of the Related Art

Traditionally, beverage containers (e.g., a traditional can of soda, as shown in FIG. 1 described hereinbelow) are available for purchase either individually, in a small pack of four or six, in a larger pack of twelve, eighteen or twenty-four or even "economy" packs of thirty, thirty-six or more. Usually such packaging comes in the form of plastic wrapping the containers together, or in the case of larger packs or economy packs, the containers are arranged on a cardboard tray, and subsequently wrapped in a plastic film.

One problem with such type of bulk packaging is that once the package is open, the remaining containers are not easy to carry around without falling over out falling out of the package, and possibly spilling the contents thereof should the container hit the ground during transport. That is, once the integrity of the plastic wrap is broken, the force keeping the containers in place is disrupted. In addition, if one of the containers is emptied, it is not convenient to merely place the container back in the original packaging. Rather, a user would either have to dispose of the container immediately, or carry it around until disposal is convenient. When the user is in an inconvenient location, for example, the beach, that is not always easy.

Furthermore, current packaging methods require the use of plastic film that is hazardous to the environment, generally cost-dependent on oil—which frequently fluctuates, and needs to be disposed of and/or recycled in addition to the containers themselves. With the exception of initially binding the containers together for packaging purposes, the plastic film serves no other purpose than added cost and waste.

FIG. 1 depicts a traditional soda can as known in the prior art. A traditional soda can generally comprises a substantially cylindrical body, having a sidewall 10, a bottom (not shown) and a top 20. The top 20 generally comprises a single opening 40 into the voluminous body of the can, which may be sealed by any number of known sealing means. In today's soda cans, the most common form of sealing means is the stay tab or pull tab 30, the operation of which is described in detail in U.S. Pat. No. 3,967,752. As is well known in the industry, the pull tab 30 works in conjunction with a surface 42 that is semi-weakened, in that it seals the can when undisturbed; however, upon lifting of the pull tab 30, the surface 42 pivots about a point or edge along the opening 40. As described in the '752 patent, one key feature of the pull tab 30 opening means is that both the pull tab 30 and the surface 42 remain connected to top 20 of the soda can in an open position.

Thus, there is a need for improved beverage containers having interlocking features with adjacent containers, allowing for ease of transportation and lower cost of packaging.

SUMMARY OF THE INVENTION

Embodiments of the present invention generally relate to nested beverage containers and methods thereof. More specifically, embodiments of the present invention relate to improved beverage containers having interlocking features with adjacent containers, allowing for ease of transportation and lower cost of packaging.

In one embodiment of the present invention, nestable beverage container comprises a top portion comprising an opening into a voluminous body, a sealing means, and a connection means positioned beneath the sealing means, a bottom portion comprising a receiving means shaped to conform to the connection means of an adjacently nested container, and the voluminous body being defined by the top portion, the bottom portion and a side wall, wherein the opening into the voluminous body is the only means for accessing contents of the nestable beverage container.

In another embodiment of the present invention, a system of nestable beverage containers comprises a first and a second beverage container, each of the first and second beverage container comprising: a top portion comprising an opening into a voluminous body, a sealing means, and a connection means positioned beneath the sealing means, a bottom portion comprising a receiving means shaped to conform to the connection means of an adjacently nested container, and the voluminous body being defined by the top portion, the bottom portion and a side wall, wherein the opening into the voluminous body is the only means for accessing contents of the nestable beverage container, and wherein the connection means of the second beverage container is securely engaged with the receiving means of the first beverage container.

In yet another embodiment of the present invention, a method of creating a system of beverage containers comprises providing a first and a second beverage container, each of the first and second beverage container comprising: a top portion comprising an opening into a voluminous body, a sealing means, and a connection means positioned beneath the sealing means, a bottom portion comprising a receiving means shaped to conform to the connection means of an adjacently nested container; and the voluminous body being defined by the top portion, the bottom portion and a side wall, wherein the opening into the voluminous body is the only means for accessing contents of the nestable beverage container, and securing engaging the connection means of the second beverage container with the receiving means of the first beverage container.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
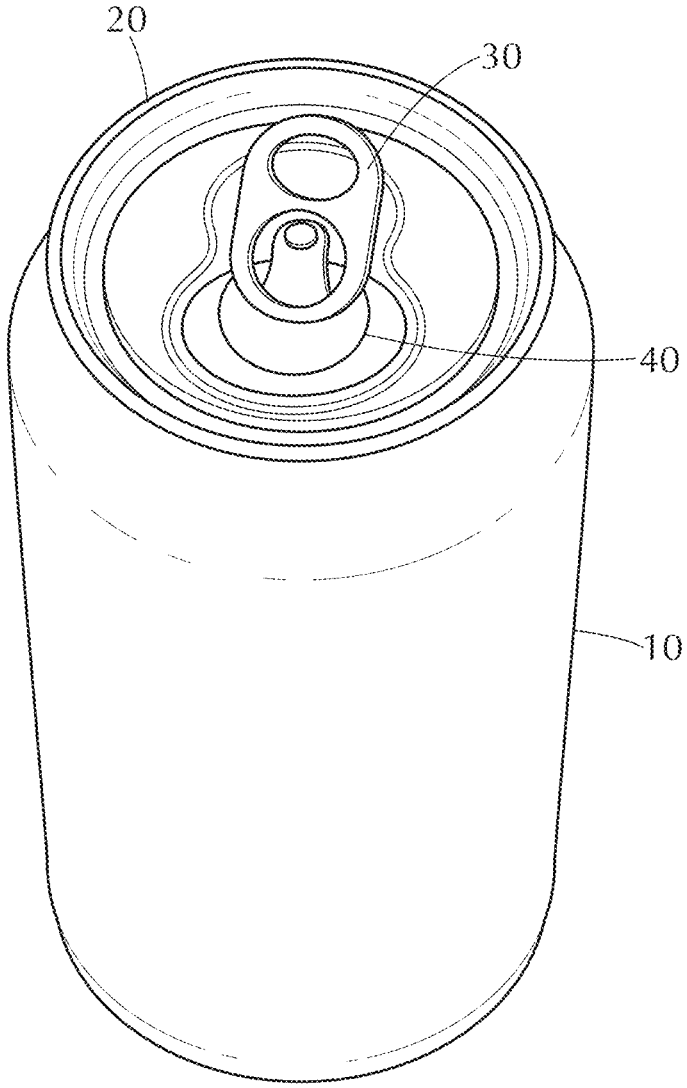
FIG. 1 depicts a traditional soda can as known in the prior art.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to nested beverage containers and methods thereof. More specifically, embodiments of the present invention relate to improved beverage containers having interlocking features with adjacent containers, allowing for ease of transportation and lower cost of packaging.

Figure 2:
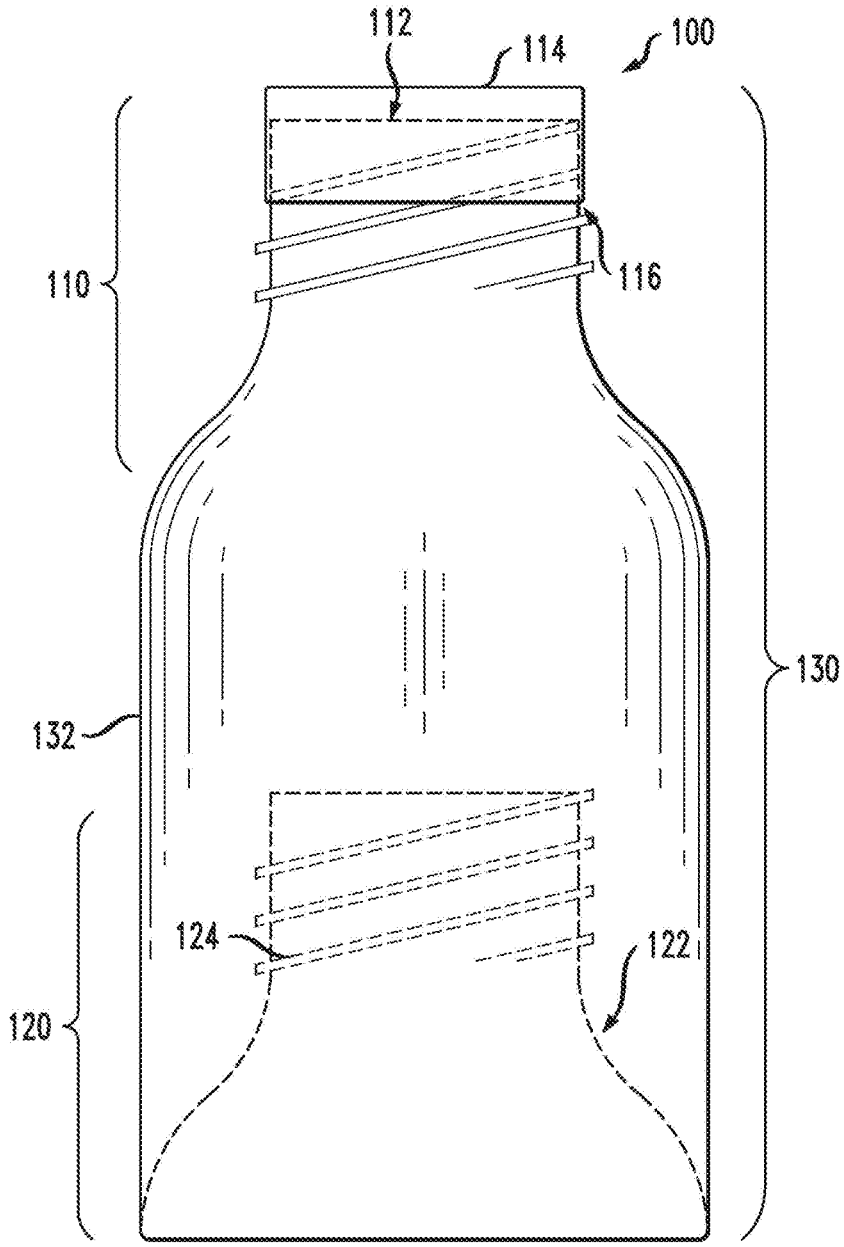
FIG. 2 depicts a side view of a nestable beverage container in accordance with one embodiment of the present invention.
Figure 3:
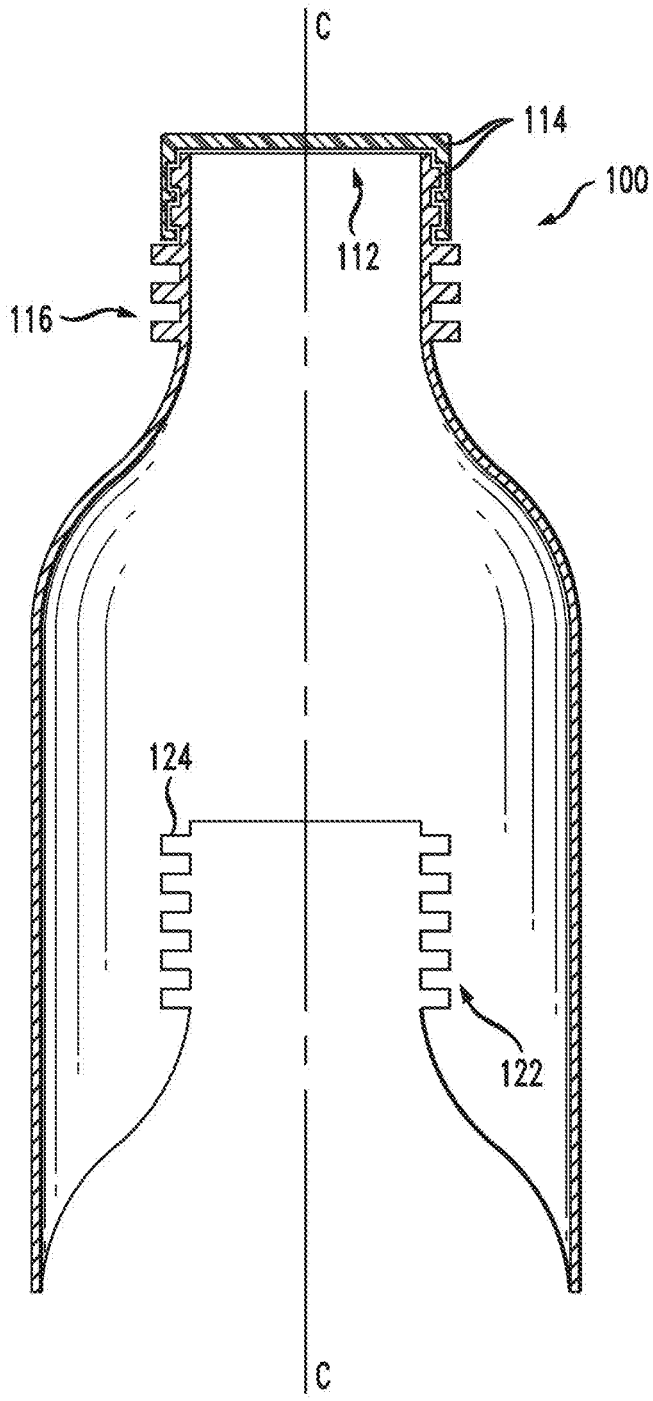
FIG. 3 depicts a cross-sectional view of the nestable beverage container of FIG. 2.
Figure 4B:
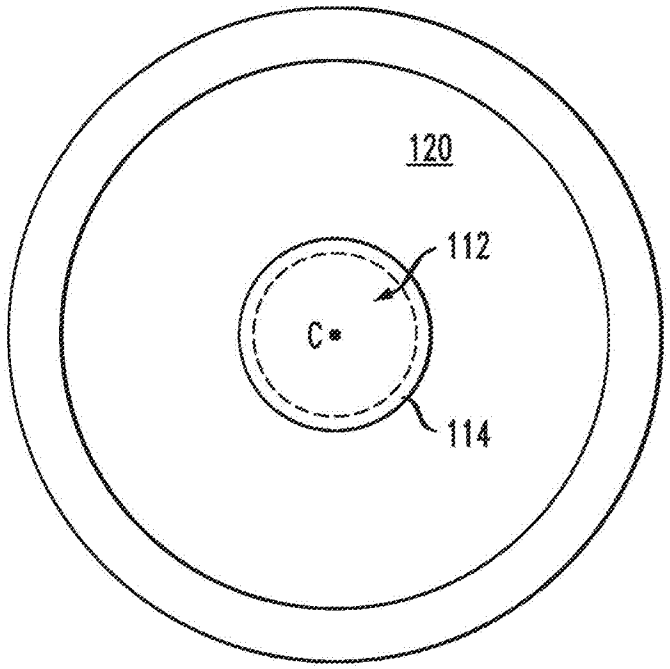
FIG. 4B depicts a bottom view of the nestable beverage container of FIG. 2.
Figure 4A:
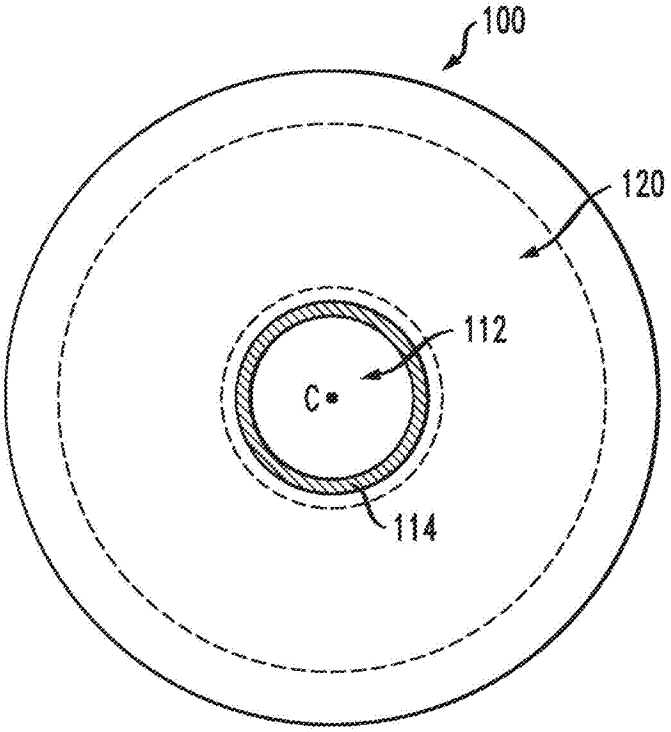
FIG. 4A depicts a top view of the nestable beverage container of FIG. 2.

FIG. 2 depicts a side view of a nestable beverage container in accordance with one embodiment of the present invention, and FIGS. 3, 4A and 4B depict cross-sectional, top and bottom views of the nestable beverage container depicted in FIG. 2, respectively. A nestable beverage container 100 generally comprises a top portion 110, a bottom portion 120 and a voluminous body 130. The voluminous body 130 is generally defined by the top portion 110, the bottom portion 120 and a side wall 132.

The nestable beverage container 100 may comprise any materials suitable for embodiments of the present invention. In one embodiment, the nestable beverage container 100 comprises at least one of a polymer, a metal, a metal alloy, glass, combinations thereof or the like.

The top portion 110 generally comprises an opening 112 into the voluminous body 130. In accordance with many embodiments of the present invention, the opening 112 is the only means for accessing an interior of the voluminous body 130 and any contents of the nestable beverage container 110.

Generally, the top portion 110 also comprises a sealing means 114. The sealing means 114 may comprise any structure suitable to control access to an interior of the voluminous body 130. In one embodiment, the sealing means 114 comprises a threaded surface and an inversely threaded cap for removably sealing the opening 112 of the nestable beverage container 100. In another embodiment, the sealing means 114 comprises a tab and semi-weakened surface covering the opening 112, for example, as found on a typical soda can as shown in FIG. 1. In further embodiments, the sealing means 114 may comprise a peelable tab, wherein the peelable tab is removably affixed over the opening 112 by an adhesive or similar type of cohesion agent. Such type of peelable tabs are commonly utilized as security or tampering devices on various food and beverage products.

In yet another embodiment, the sealing means 114 may comprise a snap-locking cap about a correlating annular tab surrounding the opening 112. In yet further embodiments, the sealing means 114 may comprise a closeable cap, for example, as found on sports drinks, whereby the concept of a threaded cap and surface combination is further complimented by a controllable opening in the cap itself. In such embodiments, the closeable cap may also comprise a dust cap, protecting the portion of the cap from undesirable contaminants.

In many embodiments of the present invention, the top portion 110 further comprises a connection means 116 for allowing the nestable beverage container 100 to be nested within an adjacent nestable beverage container. In some embodiments, the connection means comprises a threaded surface on an exterior of the nestable beverage container. In many of such embodiments, the threaded surface may extend down from a position just beneath the sealing means 114. In another embodiment, the connection means 116 may comprise a threaded surface on the exterior surface of the sealing means 114. For example, where the sealing means 114 comprises a threaded cap as described above, the connection means 116 may comprise a threaded surface on the exterior of the threaded cap. In yet further embodiments, the connection means 116 may comprise an annular projection from the exterior surface of the nestable beverage container 100, for engaging a snap-fit type structure in an adjacent nestable beverage container.

In another embodiment of the present invention, the connection means may comprise an annular ring having at least one tab projecting outward from the nestable beverage container. In such an embodiment, the at least one tab may be adapted to fit within an inverse receptive pattern with an adjacent nestable beverage container. Generally, when the tab is inserted into the receptive pattern on the adjacent nestable beverage container, with a short rotation (e.g., quarter turn, half turn, etc.) the tab may be positioned securely within the receptive pattern on the adjacent nestable beverage container. Generally, a plurality of tabs are provided in such types of embodiments.

In yet further embodiments of the present invention, the connection means 116 may comprise a specific structural design (e.g., tapering neck, hour-glass shape, etc.) of the outer surface of the top portion 110 to create a friction-type fit with an adjacent nestable beverage container.

The bottom portion 120 may generally comprise a receiving means 122 shaped to conform to the connection means 116 of an adjacently nested beverage container. In many embodiments, the receiving means 122 is substantially an inverse structure of the connection means 116, as positioned on the top portion 110. For example, in one embodiment, where the connection means 116 comprises a threaded exterior surface on a tapered side wall of the top portion 110, the receiving means 122 may comprise an inverse threaded surface 124 for receiving the threaded surface of the connection means 116, as well as an inversely tapered side wall as shown in the Figure. It should be appreciated, for embodiments of the present invention, for each type of connection means 116 disclosed herein, and variations thereof, the receiving means 122 may be structurally inverse thereto.

In many embodiments, to allow for ease of alignment with adjacent nestable beverage containers, as described hereinbelow, many of the components of the nestable beverage containers may be symmetrical about a central axis C—C passing through the center of top portion 110, the bottom portion 120, and the voluminous body 130. In certain embodiments, however, it is understood it may not be practical to have each and every component symmetrical thereon, for example, where the nestable beverage container is similar to a traditional soda can, the single opening thereof is positioned off-center.

Figure 5:
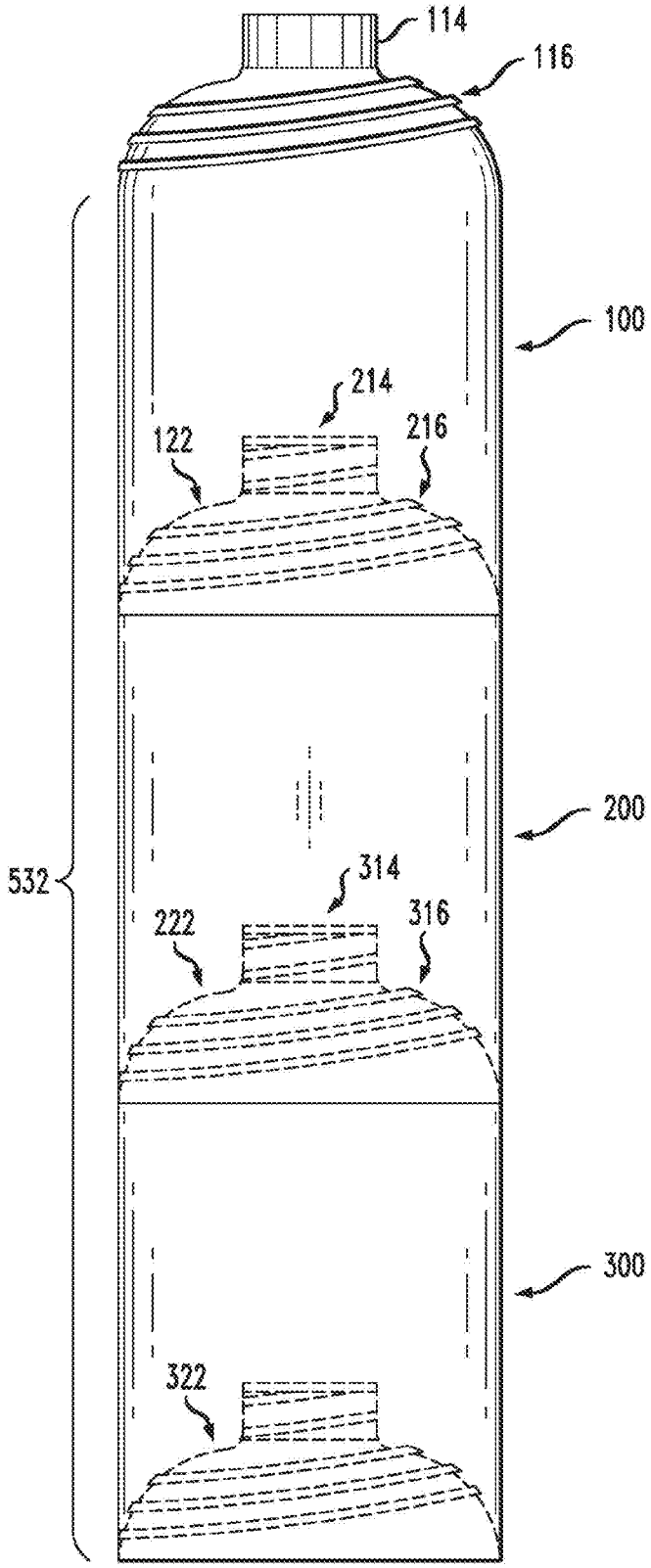
FIG. 5 depicts a system of nested beverage containers in accordance with one embodiment of the present invention.

FIG. 5 depicts a system of nested beverage containers in accordance with one embodiment of the present invention. The system 500 generally comprises at least a first nestable beverage container 100 and a second nestable beverage container 200. In certain embodiments, however, a third nestable beverage container 300 up to n nested beverage containers, wherein n is any number feasible within the context of embodiments of the present invention, may be provided within the system 500.

Each of the nestable beverage containers within the system 500 generally comprise a top portion, a bottom portion and a voluminous body, as described hereinabove. To create system 500, however, once each of the nestable beverage containers is provided, e.g., the first nestable beverage container 100 and the second nestable beverage container 200, the connection means 216 of the second beverage container 200 is securely engaged with the receiving means 122 of the first beverage container 100. As shown, the connection means 216 comprises a threaded surface on an exterior surface of the second nestable beverage container 200, and the receiving means 122 comprises a corresponding inverse threaded surface for receiving the connection means 216.

Similarly, in system 500, where a third nestable beverage container 300 is provided, the connection means 316 of the third beverage container 300 is securely engaged with the receiving means 222 of the second beverage container 200. As shown, the connection means 316 comprises a threaded surface on an exterior surface of the third nestable beverage container 300, and the receiving means 222 comprises a corresponding inverse threaded surface for receiving the connection means 316.

In many embodiments, system 500 may comprise nestable beverage containers, similarly structured with the exception of the sealing means on each nestable beverage container. For example, in one embodiment, system 500 may comprise a first nestable beverage container 100 comprising a sealing means 114 comprising a threaded cap, as described hereinabove. In the same embodiment, however, the second nestable beverage container 200 may comprise a sealing means 214 comprising a peelable tab over the opening thereof, as well as having a threaded exterior surface for receiving a threaded cap, despite no cap necessarily being provided thereon.

In such an exemplary embodiment, the user of the system 500 may be able to consume the contents of the first nestable beverage container 100, separate the first nestable beverage container 100 from the system 500, and from the connection means 216 of the second nestable beverage container 200. The first nestable beverage container 100 may then be securely engaged using the connection means 116 with the receiving means 322 of the third nestable beverage container 300. In addition, the user may optionally remove the threaded cap of the sealing means 114. The user may then remove the peelable tab of the sealing means 214 and replace it with the threaded cap. Generally, in such an embodiment, the third nestable beverage container 300 will also comprise a sealing means comprising a peelable tab. As such, the user will be able to have a resealable threaded cap on whichever of the nestable beverage containers is the topmost container within the system 500.

Optionally, with embodiments of the present invention, when a plurality of nestable beverage containers are engaged within a system 500, each of the side walls of the respective nestable beverage containers align to form a substantially continuous side wall 532. It should be appreciated, however, where certain embodiments of the present invention may not comprise nestable beverage containers having constant diameter or shaped side walls, the alignment of adjacent sidewalls may only comprise the alignment of the bottom portion of a first nestable beverage container 100 with the sidewall of a second nestable beverage container, such that it may not be readily identifiable upon an initial glance where a first nestable beverage container ends and the second nestable beverage container begins.

Figure 6:
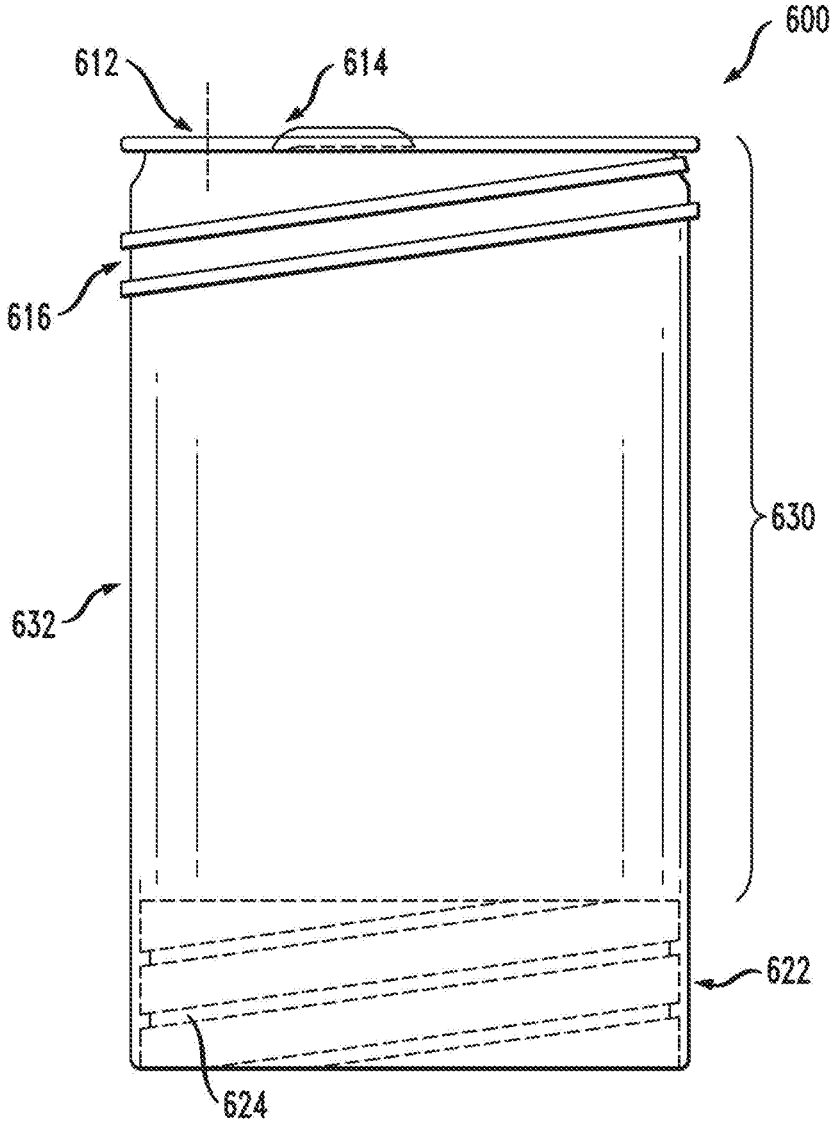
FIG. 6 depicts a side view of a nestable beverage container in accordance with one embodiment of the present invention.

Although FIGS. 2-5 depict a nestable beverage container in the general form of a bottle, FIG. 6 depicts a side view of a nestable beverage container in accordance with one embodiment of the present invention. FIG. 6 depicts a nestable beverage container 600 substantially in the shape of a traditional soda can, such as the one shown in FIG. 1. However, similar to the embodiments depicted in FIGS. 2-5, the nestable beverage container 600 comprises a top portion, a bottom portion and a voluminous body 630, wherein the voluminous body 630 is defined by the top portion, the bottom portion and a side wall 632.

The top portion generally comprises an opening 612 into the voluminous body 630, a sealing means 614, and a connection means 616 positioned beneath the sealing means 614. In the exemplary embodiment, the sealing means 614 comprises a tab and semi-weakened surface covering the opening 612. However, any of the aforementioned sealing means may be suitable for the exemplary embodiment as well. As shown, the connection means 616 comprises a threaded surface on the exterior of the nestable beverage container 600. Similarly, however, any of the aforementioned connection means may be suitable for the exemplary embodiment.

The receiving means 622 of the nestable beverage container 600 may comprise any suitable structure to adapt to the connection means 616, for example, an inversely threaded surface 624 to receive and securely engage the connection means of an adjacent nestable beverage container.

Figure 7:
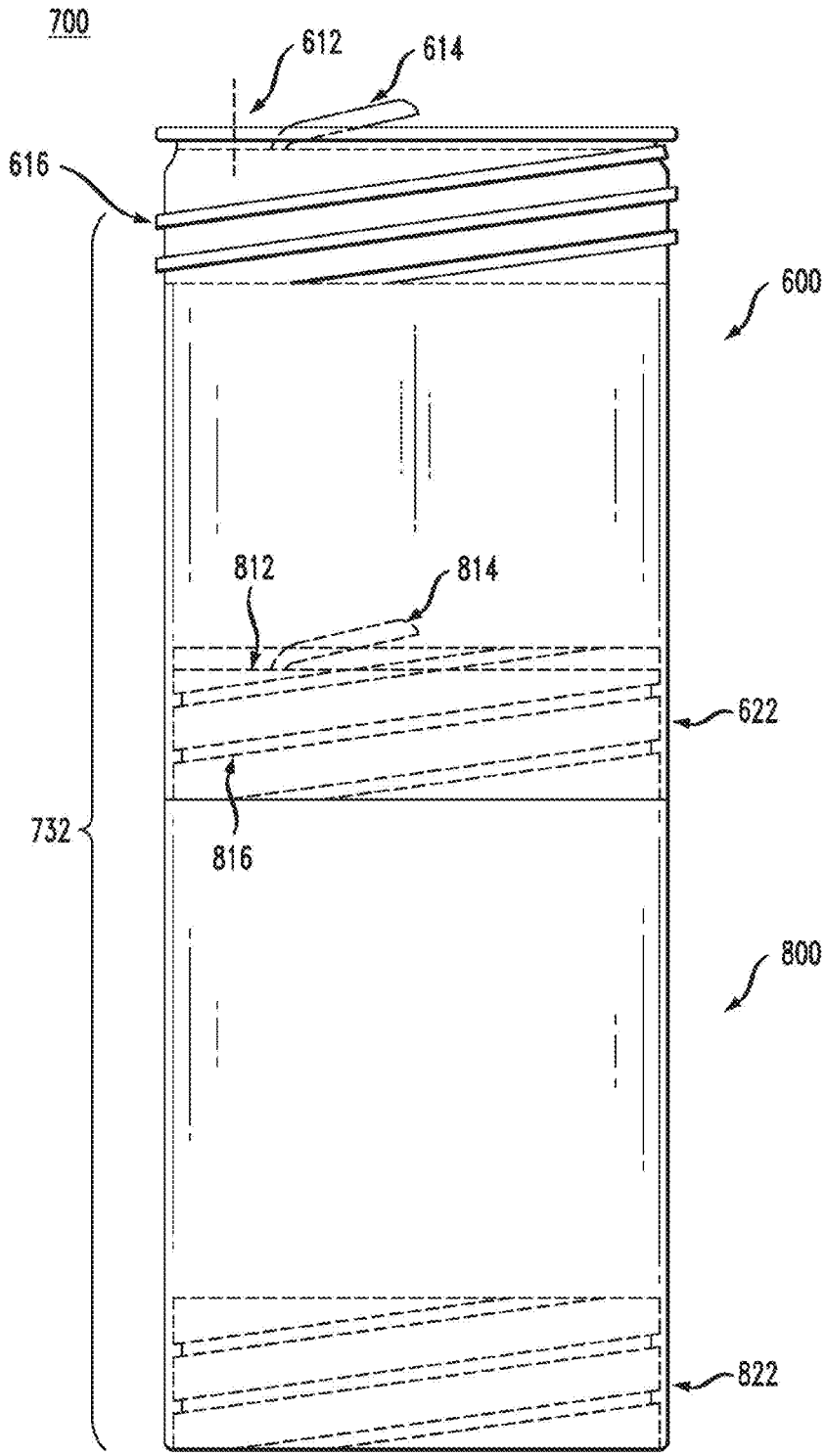
FIG. 7 depicts a system of nested beverage containers in accordance with one embodiment of the present invention.

FIG. 7 depicts a system of nested beverage containers in accordance with one embodiment of the present invention. The system 700 generally comprises at least a first nestable beverage container 600 and a second nestable beverage container 800. In certain embodiments, however, up to n nested beverage containers, wherein n is any number feasible within the context of embodiments of the present invention, may be provided within the system 700.

Each of the nestable beverage containers within the system 700 generally comprise a top portion, a bottom portion and a voluminous body, as described hereinabove. To create system 700, however, once each of the nestable beverage containers is provided, e.g., the first nestable beverage container 600 and the second nestable beverage container 800, the connection means 816 of the second beverage container 800 is securely engaged with the receiving means 622 of the first beverage container 600. As shown, the connection means 816 comprises a threaded surface on an exterior surface of the second nestable beverage container 800, and the receiving means 622 comprises a corresponding inverse threaded surface for receiving the connection means 816.

In many embodiments, it may be desirable to affix a non-beverage item to the bottom and/or top of a beverage container. For example, it may be desirable to package food with a beverage. In one embodiment, it may be desirable to affix a can of peanuts to a beer can. In another embodiment, it may be desirable to affix a can of popcorn (popped or unpopped) to a can of soda. In yet another embodiment, it may be desirable to affix a container of ice or ice pack to the bottle and/or top of any beverage container. In a further embodiment, it may be desirable to affix crackers to a can of soup.

In accordance with embodiments of the present invention, the second nestable beverage container 800, as shown in FIG. 7, may be utilized as a non-beverage container for storing food or other articles. Depending on the nature of the food or other articles, the size and shape of the second nestable container may vary to fit a particular application. In one embodiment, the height of the second nestable container may be shorter than the first nestable beverage container. In another embodiment, the second nestable container may be any variation of shape provided it comprises a means for connecting to the receiving means of the first nestable beverage container. For example, in one embodiment, where an ice pack is desired to be affixed to a beer can, the ice pack may be provided in the shape of an insulated holder (commonly known as a coozie), having a connection means positioned on a surface thereof positioned against the bottom of the first nestable beverage container (e.g., the beer can).

In other embodiments, depending on the nature of the non-beverage product being stored, the second nestable container may comprise a different sealing means than the first nestable container. For example, where a beer and peanuts are being stored together, the beer can may comprise a pull tab-type sealing means, as described in FIG. 1, whereas the peanut can may comprise a peelable tab sealing means. Such peelable tab may comprise a piece of foil or similar material shaped to fit over an entire opening of the second nestable container, and removably affixed thereon by adhesive or similar cohesive agent. A tab of foil, or similar material, extends from the top of the piece of foil near an outer edge thereof, and upon pulling the tab, the piece of foil can be removed. Such a peelable tab is commonly used on food products, pharmaceutical products, etc., to ensure security of the products contained therein.

Figure 8:
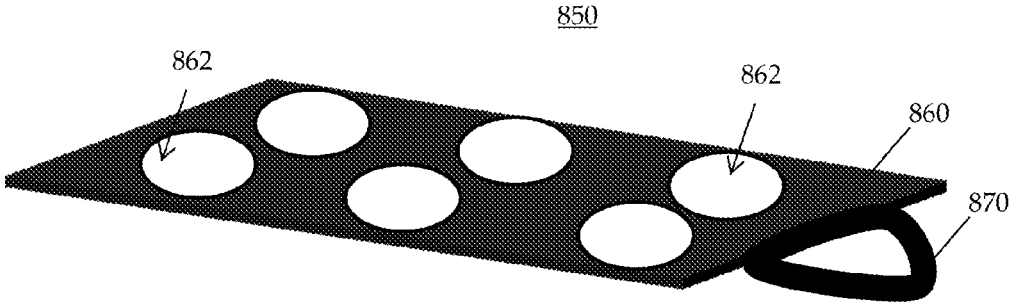
FIG. 8 depicts a carrier for packaging a system of nested beverage containers in accordance with one embodiment of the present invention.

FIG. 8 depicts a carrier for packaging a system of nested beverage containers in accordance with one embodiment of the present invention. As shown in the Figure, the carrier 850 generally comprises a support portion 860 having at least one aperture 862 therethrough, and an optional handle portion, for example, handle 870. In an alternative embodiment, the handle 870 may comprise a perpendicular projection from the top of the support portion 860.

In accordance with embodiments of the present invention, a system of nestable containers, as shown in FIG. 7, may be carried via the carrier 850. In such an embodiment, the connection means of the second container may be placed through the aperture 862 before engaging the receiving means of the first container. In doing so, the carrier 850 effectively becomes locked between the two containers.

The carrier may be provided with anywhere from one to any number of apertures 862 in the support portion 860. In one commercial embodiment, the carrier may be provided with any of three, six, nine, twelve or fifteen apertures 862, permitting the overall system to provide six, twelve, eighteen, twenty-four or thirty containers therein, which are traditionally the quantity by which soda and/or beer is sold.

The carrier may be made from any of plastic, metal, cardboard, organic materials, combinations thereof or the like. In many embodiments, the carrier is manufactured from cardboard or reinforced/corrugated cardboard, capable of supporting the quantity of containers thereon. In some embodiments, the support platform 860 may comprise a first material, and the handle portion 870 another material. For example, the support platform 860 may comprise a cardboard material, while the handle comprises a rope, such as a hemp rope. In many of such embodiments, all of the carrier materials may be biodegradable or otherwise environmentally friendly.

Figure 9:
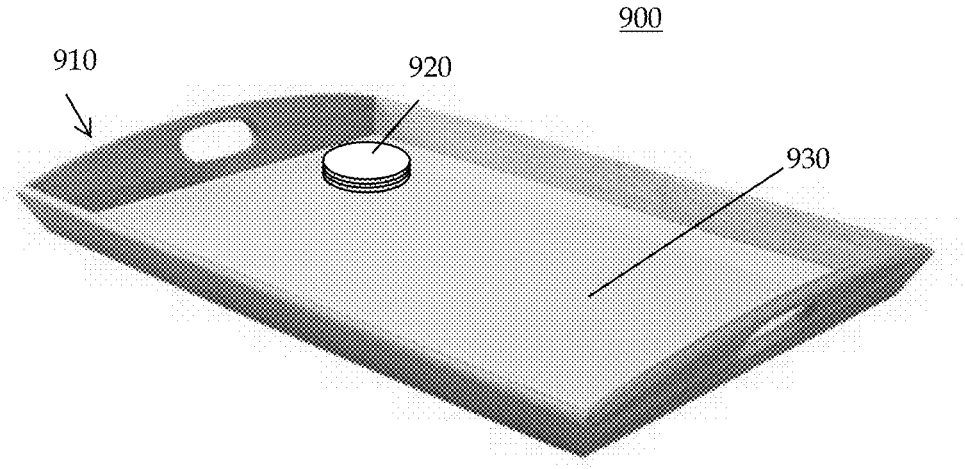
FIG. 9 depicts a tray for packaging a system of nested beverage containers in accordance with one embodiment of the present invention.

FIG. 9 depicts a tray for packaging a system of nested beverage containers in accordance with one embodiment of the present invention As shown in the Figure, the tray 900 may generally comprise a tray platform 910 and at least one connection means 920. The connection means 920 may comprise any of the types of connection means discussed herein, for adapting to a receiving means of a nestable container (not shown). In accordance with embodiments of the present invention, any number of connection means 920 may be provided on a single tray 900. Optionally, the tray may further comprise a flat and/or recessed portion 930 for placing miscellaneous items thereon.

In many embodiments, the tray may be utilized to temporarily carry a nestable container as well as additional items. For example, at a baseball game, a patron may desire to grab a couple sodas and some food. By utilizing a tray, as disclosed herein, the patron may be able to secure the sodas provided in a nestable container as described herein, while placing the food on the flat portion 930 of the tray 900. By having the nestable containers affixed therein, the patron may be able to prevent spills, dropped cups/cans/bottles, and the like, when walking or moving with the tray 900.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. A carrier system for nestable containers comprising:

a first beverage container comprising:

a substantially cylindrical voluminous body being defined by a top portion, a bottom portion and a sidewall;

the top portion comprising a single opening into a voluminous body, a sealing means for temporarily sealing the contents of the first beverage container, the sealing means consisting of a pull tab and semi-weakened surface covering the opening, and a connection means positioned beneath the sealing means;

the bottom portion comprising a receiving means; and wherein the semi-weakened surface covering the opening remains attached to the top portion in an open position;

a second container comprising:

a voluminous body being defined by a top portion, a bottom portion and a sidewall;

the top portion comprising a single opening in to a voluminous body, a sealing means for temporarily sealing the contents of the second container, and a connection means positioned beneath the sealing means, the connection means shaped to be received by the receiving means of the first beverage container; and a carrier comprising:

a support platform having at least one aperture therethrough;

wherein the aperture is sized to permit the connection means of the second container to be received by the receiving means of the first beverage container.

2. The carrier system of claim 1, wherein the second container further comprises a receiving means in its bottom portion, the receiving means for adapting to another adjacently positioned container.

3. The carrier system of claim 1, wherein the connection means of the first and second containers each comprise a threaded section on an exterior surface of the sidewall, adjacent to the top portion.

4. The carrier system of claim 1, wherein the receiving means of the first beverage container comprises an inverse profile of at least the top portion thereof.

5. The carrier system of claim 1, wherein the carrier comprises at least one of plastic, metal, cardboard, organic materials, or combinations thereof.

6. The carrier system of claim 5, wherein the carrier comprises corrugated cardboard.

7. The carrier system of claim 1, wherein the first and second containers each comprise at least one of a polymer, a metal, a metal alloy, glass or combinations thereof.

8. The carrier system of claim 1, wherein the side wall of the first beverage container aligns with the side wall of the second container when the second container is nested within the first beverage container.

9. The carrier system of claim 1, wherein the first beverage container comprises soda, beer, water, juice, energy drink, or combinations thereof.

10. The carrier system of claim 1, wherein the support platform of the carrier comprises any of three, six, nine, twelve or fifteen apertures therethrough.

* * * * *